United States Patent [19]

Gajjar

[11] Patent Number: 4,802,346

[45] Date of Patent: Feb. 7, 1989

[54] METHOD OF WARP KNITTING

[75] Inventor: Bahrat J. Gajjar, Wilmington, Del.

[73] Assignee: E. I. Du Pont De Nemours and Company, Wilmington, Del.

[21] Appl. No.: 135,395

[22] Filed: Dec. 21, 1987

[51] Int. Cl.[4] ..... D04B 21/00

[52] U.S. Cl. ..... 66/195; 66/190

[58] Field of Search ..... 66/192, 193, 195, 202, 66/191, 190

[56] References Cited

U.S. PATENT DOCUMENTS

| | | | |
|---|---|---|---|
| 3,442,099 | 5/1969 | Auville et al. . | |
| 3,494,150 | 2/1970 | Grau . | |
| 3,552,154 | 1/1971 | Lesley . | |
| 3,910,075 | 10/1973 | Holliday | 66/192 |
| 3,931,721 | 1/1976 | Adamson | 66/197 |
| 4,307,587 | 12/1981 | Baesgen et al. | 66/195 |
| 4,638,648 | 1/1987 | Gajjar | 66/202 |
| 4,649,722 | 3/1987 | Gajjar | 66/195 |
| 4,667,490 | 5/1987 | Patel | 60/202 |
| 4,688,403 | 8/1987 | Gajjar | 66/202 |

FOREIGN PATENT DOCUMENTS

| | | | |
|---|---|---|---|
| 61-119757 | 6/1986 | Japan | 66/192 |

*Primary Examiner*—Ronald Feldbaum

[57] ABSTRACT

Warp-knit fabric having a two-course repeat pattern of alternating first and second bar yarns. The fabric is prepared by interlocking the first and second bar yarns using a combination of knit and layed-in stitches in opposite fashion.

5 Claims, 6 Drawing Sheets

FIG. 28
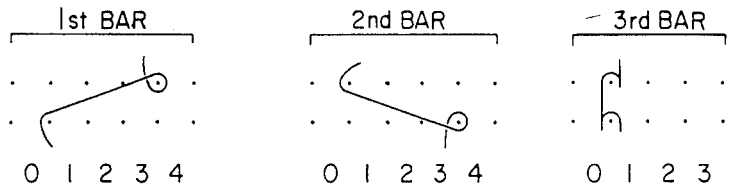
FIG. 29
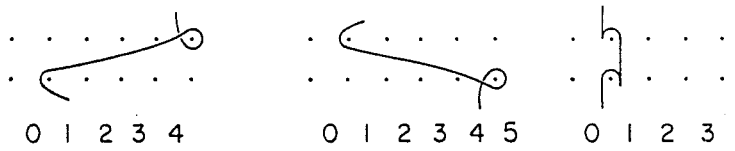
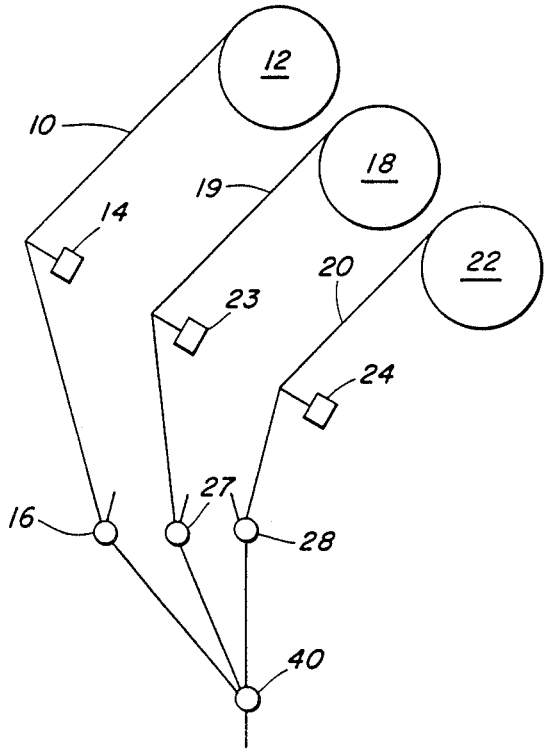
FIG. 30

METHOD OF WARP KNITTING

BACKGROUND OF THE INVENTION

This invention relates to warp knitted fabrics and more particularly to a method of knitting the fabrics wherein front and back bar yarns appear both on the face and back of the fabric.

Spun yarn can be knit on warp knitting machines but it is difficult to obtain the good knitting performance of continuous filament yarns even at much slower knitting speeds. For example, the knitting performance of a continuous filament 40 denier nylon yarn on a 28 or 32 gauge tricot knitting machine is in the range of from 1000 to 2000 racks per end out (a rack being 480 courses) at a knitting speed of 1000 to 2000 stitches per minute. On the other hand, the knitting performance of 50/1 cc to 70/1 cc spun yarn is in the range of about 100 racks per end out even at much lower knitting speeds such as 600 stitches per minute.

SUMMARY OF THE INVENTION

This invention provides a method of preparing fabric of yarn with improved knitting performance while improving the uniformity of the fabric. The method involves operating the front or first guide bar of a warp knitting machine in a repeating pattern of alternating laid-in and knit in stitches, while operating the back or second guide bar in a repeating stitch pattern that is opposite to the stitch pattern of the first guide bar so that when the first guide bar threads are laid-in, second guide bar threads are knit-in, and subsequently repeating both stitch patterns to interlock along the fabric. The method may also include the additional step of operating a third guide bar in conjunction with the first and second guide bars in a knit-in or laid-in stitch pattern. The yarns used with this method may be textured or untextured continuous filament or spun yarns or these in combination with elastomeric yarns.

BRIEF DESCRIPTION OF THE DRAWINGS

FIGS. 1–29 are stitch pattern diagrams for the fabrics made according to this invention.

FIG. 30 is a schematic elevation of the apparatus elements for warp knitting the fabrics made according to this invention.

DETAILED DESCRIPTION OF THE ILLUSTRATED EMBODIMENTS

Figure 1:
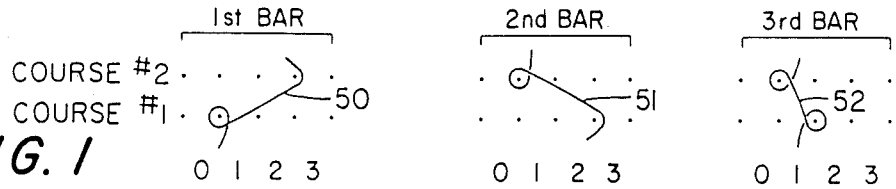
Figure 2:
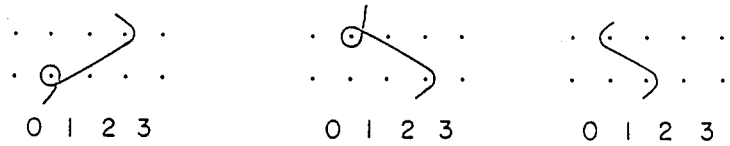
Figure 3:
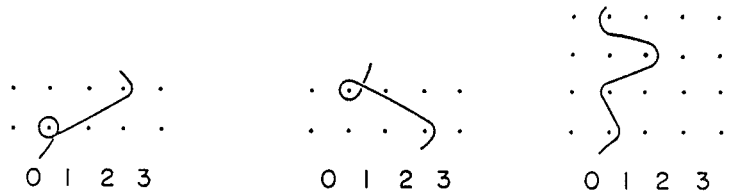
Figure 4:
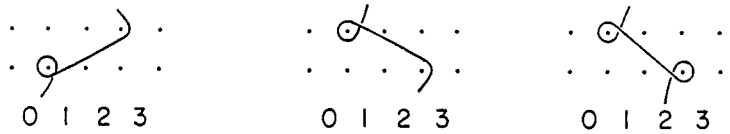
Figure 5:
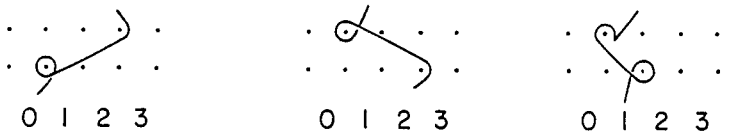
Figure 6:
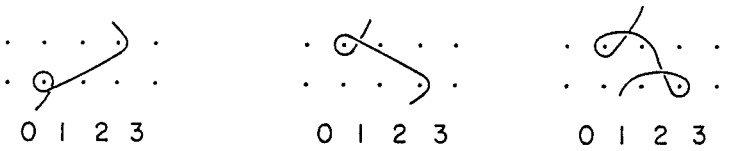
Figure 7:
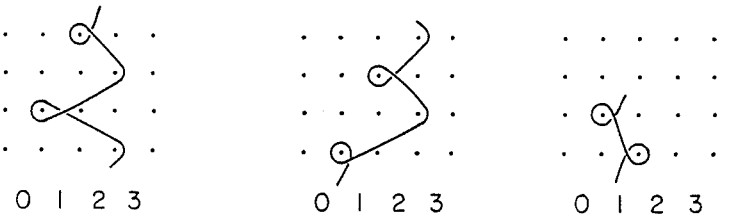
Figure 8:
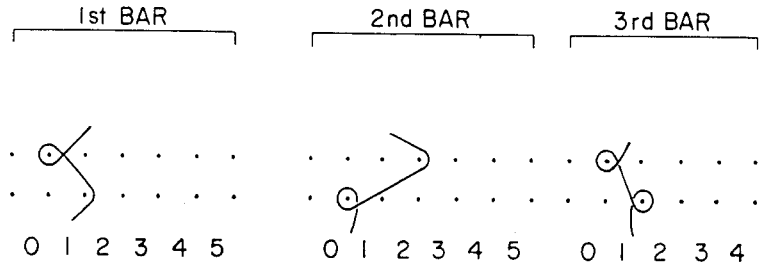
Figure 9:
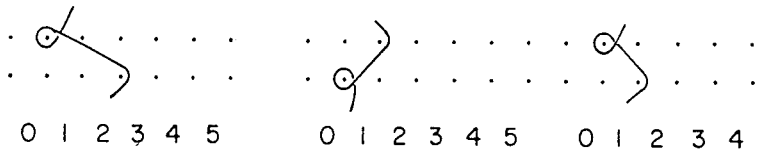
Figure 10:
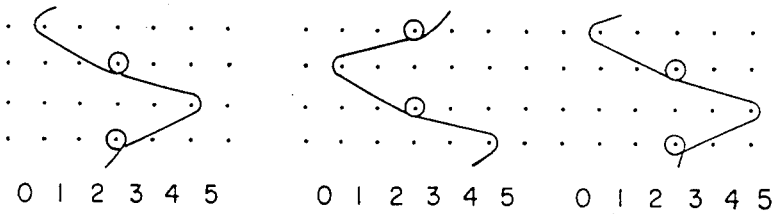
Figure 11:
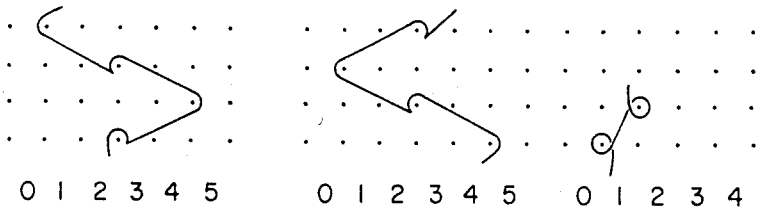
Figure 12:
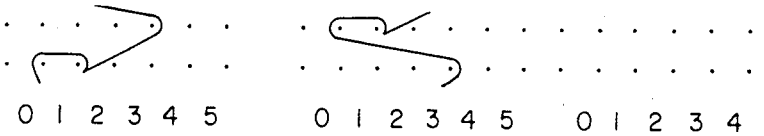
Figure 13:
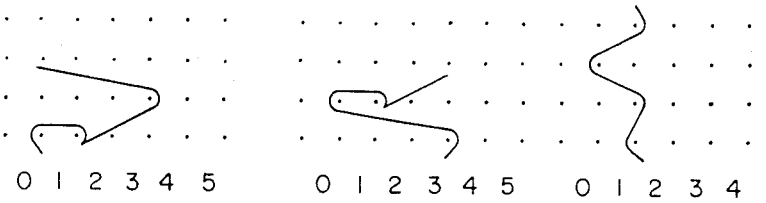
Figure 14:
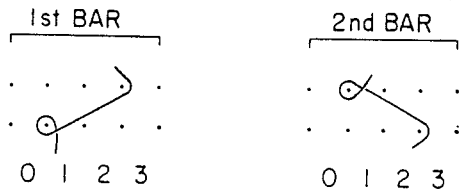
Figure 15:
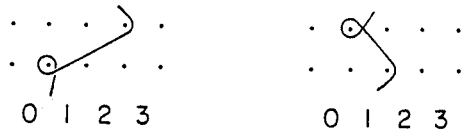
Figure 16:
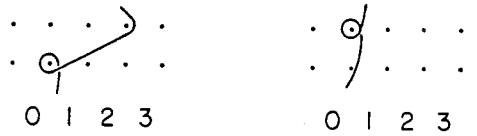
Figure 17:
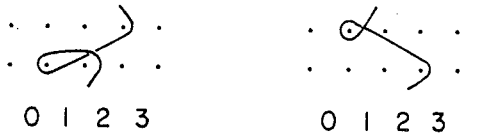
Figure 18:
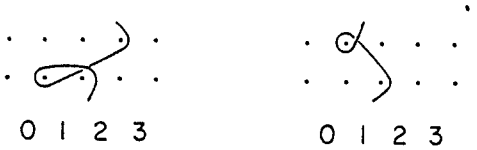
Figure 19:
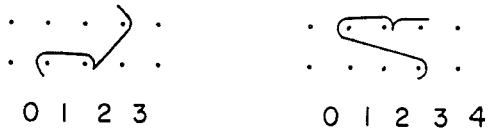
Figure 20:
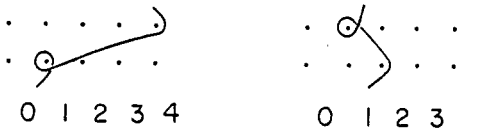
Figure 21:
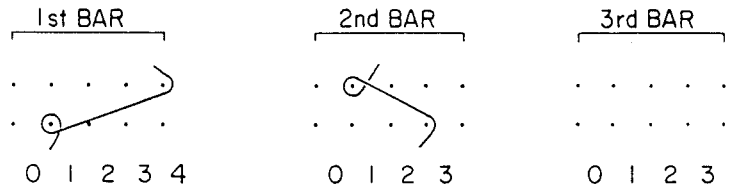
Figure 22:
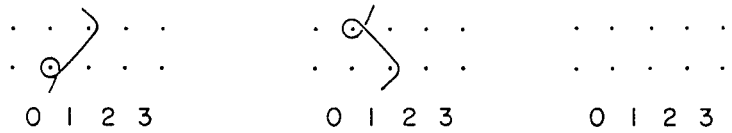
Figure 23:
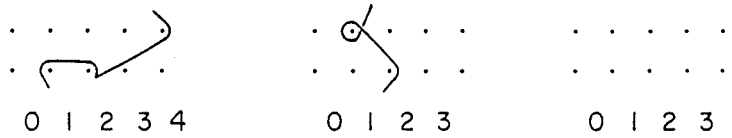
Figure 24:
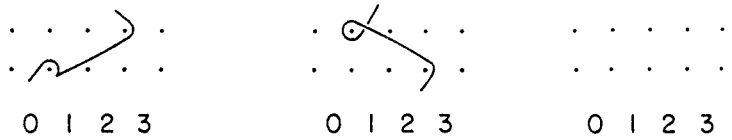
Figure 25:
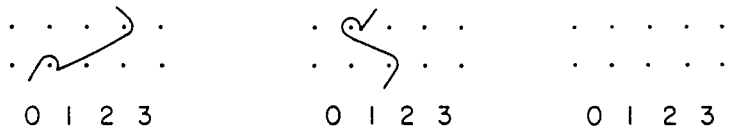
Figure 26:
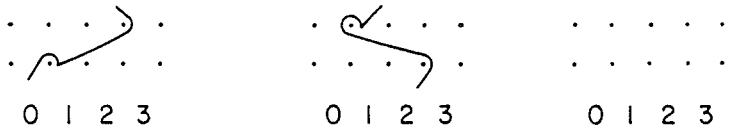
Figure 27:
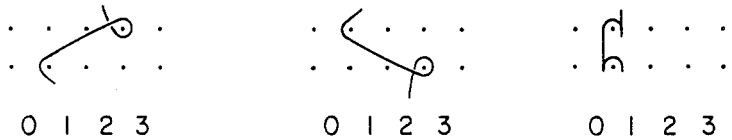

The invention is best defined in terms of stitch patterns as shown in FIGS. 1 to 26 for warp knit fabrics with two sets of nonelastomeric threads (textured, untextured or spun yarns) or a combination of one or two sets of these nonelastomeric threads with one set of elastomeric threads.

For each of the Figs. represented a single needle-bar is employed, which is fed from a front or first bar and one or more second, third or back guide bars. Knitting needle positions for each of a plurality of successive courses are represented in the diagrams by horizontal lines of dots, the top line representing the course formed immediately after the course represented by the bottom line. One first or front-bar end and two or more other bar ends are shown in each instance, it being understood that one end of each is knitted on each knitting needle for every course. More particularly, referring to FIG. 1 the stitch construction of the fabric is notationally set out and shows that the threads of the first or front bar, one of which is indicated at 50, have back-and-forth movement to nonadjacent needles in successive courses as indicated by the numbers 1-0, 3-3 and that the threads of the second and third bars 51,52 have similar movements as indicated by the numbers (3-3, 1-0); (1-2, 1-0) respectively.

The fabric is preferably made according to the invention on a tricot or similar warp knitting machines employing a single needle bar and at least three guide bars respectively known as the back middle and front guide bars. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both bars are also swingable transversely of the needle bar to permit their yarn guides to pass between the needles, the combined shogging and swinging movements permitting the yarns to be fed to the needles and to be knit thereby.

The schematic illustration for such a warp knitting machine is shown in FIG. 30. The front or first guide bar warp is fed from threads 10 on beam 12. The threads 10 pass in the usual well-known manner through a fixed reed 14 which serves to keep the threads separated. From the reed each thread 10 is threaded through its guide in guide bar 16 and onto needle bed 40. The threads 19 from beam 18 and threads 20 from beam 22 are fed through respective fixed reeds 23,24 and second and third guide bars 27,28 to needle bed 40. It should be understood that the beams could be split and/or fully or partially threaded.

The movements of needles through successive courses are indicated below each diagram by their numbers (FIGS. 1–29) as set forth in Table I.

TABLE I

| FIG. No. | Front or 1st Bar | Middle or 2nd Bar | Back or 3rd Bar |
|---|---|---|---|
| 1 | 1-0, 3-3 | 3-3, 1-0 | 1-2, 1-0 |
| 2 | 1-0, 3-3 | 3-3, 1-0 | 2-2, 0-0 |
| 3 | 1-0, 3-3 | 3-3, 1-0 | 1-1, 0-0, 2-2, 0-0 |
| 4 | 1-0, 3-3 | 3-3, 1-0 | 2-3, 1-0 |
| 5 | 1-0, 3-3 | 3-3, 1-0 | 1-2, 0-1 |
| 6 | 1-0, 3-3 | 3-3, 1-0 | 1-3, 2-0 |
| 7 | 3-3, 1-0, 3-3, 2-1 | 1-0, 3-3, 2-1, 3-3 | 1-2, 1-0 |
| 8 | 2-2, 1-0, | 1-0, 3-3, | 1-2, 1-0 |
| 9 | 3-3, 1-0 | 1-0, 2-2 | 2-2, 1-0 |
| 10 | 3-2, 5-5, 2-3, 0-0 | 5-5, 2-3, 0-0, 3-2 | 3-2, 5-5, 2-3, 0-0 |
| 11 | 2-3, 5-5, 3-2, 0-0 | 5-5, 3-2, 0-0, 2-3 | 1-0, 1-2 |
| 12 | 0-2, 4-4 | — | 4-4, 0-2 |
| 13 | 0-2, 4-4 | 4-4, 0-2 | 1-1, 2-2, 0-0, 2-2 |
| 14 | 1-0, 3-3 | 3-3, 1-0 | — |
| 15 | 1-0, 3-3 | 2-2, 1-0 | — |
| 16 | 1-0, 3-3 | 1-1, 1-0 | — |
| 17 | 2-0, 3-3 | 3-3, 1-0 | — |
| 18 | 2-0, 3-3 | 2-2, 1-0 | — |
| 19 | 0-2, 3-3 | 3-3, 0-2 | — |
| 20 | 1-0, 4-4 | 2-2, 1-0 | — |
| 21 | 1-0, 4-4 | 3-3, 1-0 | — |
| 22 | 1-0, 2-2 | 2-2, 1-0 | — |
| 23 | 0-2, 4-4 | 2-2, 1-0 | — |
| 24 | 0-1, 3-3 | 3-3, 1-0 | — |
| 25 | 0-1, 3-3 | 2-2, 0-1 | — |
| 26 | 0-1, 3-3 | 3-3, 0-1 | — |
| 27 | 0-0, 2-3 | 2-3, 0-0 | 1-0, 0-1 |
| 28 | 0-0, 3-4 | 3-4, 0-0 | 1-0, 0-1 |

TABLE I-continued

| FIG. No. | Front or 1st Bar | Middle or 2nd Bar | Back or 3rd Bar |
|---|---|---|---|
| 29 | 0-0, 4-5 | 4-5, 0-0 | 0-1, 1-0 |

EXAMPLE

A tricot warp knitting machine was employed to produce ten fabrics as identified in Table II as fabric Nos. A through J.

Figure 31:
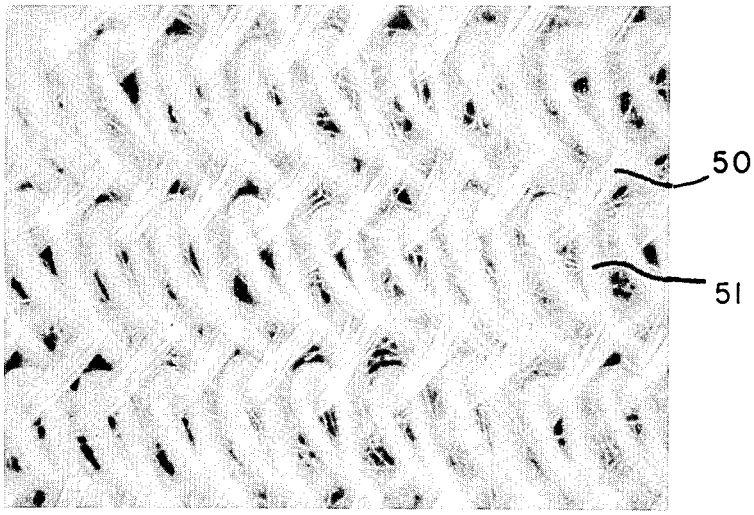
FIGS. 31 and 32 are photographs of the face (loop) and back (float) side of fabric knit according to the invention (Fabric F).
Figure 32:
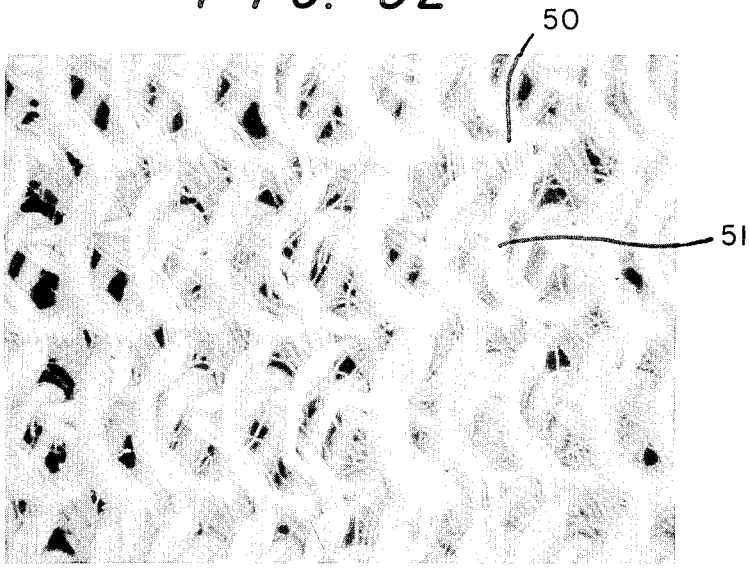

Fabrics A, E and J are control fabrics. Fabric F of this invention is shown in FIGS. 31 and 32.

The test methods for determining thickness, bulk, static extension, air permeability and power, and finishing procedures for the fabrics are detailed below.

Test Methods

Thickness is measured according to ASTM D1777-64 using apparatus commercially available from Customer Scientific Instruments, Inc., Whippany, N.J. Thickness is measured in inches.

Bulk (specific volume) is calculated according to the formula:

$$\text{Bulk (cm}^3\text{/g)} = \frac{2.54 \times 8361 \times T}{28.35\ W}$$

wherein

T = Thickness (inches)

W = Weight (g/cm$^2$)

Hand Stretch is the percent length change of a fabric sample pulled by hand expressed as a percentage of original relaxed length.

Power is measured in general accordance with ASTM D 177581. A three (3) inch wide fabric sample is stretched at a constant rate on an Elongation Tensile Testing Machine under a load of twelve (12) pounds. Power is the force in pounds per square inch of fabric area at fifty percent (50%) elongation on the unload cycle.

FINISHING PROCEDURE

Step 1—Steam the fabrics.

Step 2—Heat set the fabrics on the Pin Tenter at 375° F. 4 boxes—50 secs. 7% overfeed and 7% over with the greige fabric.

Step 3—Beck scour and dye the fabrics.

Step 4—Dry on the Pin Tenter at 290° F. 30 yds/min and set the Pin Tenter at the fabric's wet width.

TABLE II

FABRIC CONSTRUCTION AND GREIGE FABRIC PROPERTIES (A) FABRIC CONSTRUCTION

| Fabric No. | Front Bar Yarn* | Middle Bar Yarn | Back Bar Yarn | Machine Gauge | Quality | Runners F.B./ M.B./B.B. | Stitch Const. F.B./M.B./B.B. | Type Fabric |
|---|---|---|---|---|---|---|---|---|
| A | 40-26 P875 AB | — | 40-26 P875 AB* | 32 | 9" | 62"/46" | 2-3,1-0/1-0,1-2 | Control |
| B | 40-12 P875 AB | — | 40-12 P875 AB* | 32 | 8" | 31"/31" | 3-3,1-0,/1-0,3-3 | Test |
| C | 40-12 P875 AB | — | 40-12 P875 AB* | 32 | 6" | 28.5"/28.5" | 3-3,1-0/1-0,3-3 | Test |
| D | 40-12 P875 AB | — | 40-12 P875 AB* | 32 | 3⅜" | 25.5"/25.5" | 3-3,1-0/1-0,3-3 | Test |
| E | 40-12 P875 AB | — | 50/1 cc spun | 28 | 3⅜" | 69.5"/53.5" | 2-3,1-0/1-0,1-2 | Control |
| F | 40-12 P875 AB | — | 50/1 cc spun | 28 | | 35.25"/35.25" | 1-0,3-3/3-3,1-0 | Test |
| G | 50/1 cc spun | 40-13 Nylon | 40 d. "Lycra" T126 | 28 | 9" | 42"/40"/40" | 1-0,3-3/3-3,1-0/1-0,1-2 | Test |
| H | 50/1 cc spun | 50/1 cc spun | 40 d. "Lycra" T126 | 28 | 7" | 46"/46"/40" | 1-0,3-3/3-3,1-0,/1-0,1-2 | Test |
| I | 50/1 cc spun | 50/1 cc spun | 40 d. "Lycra" T126 | 28 | 9" | 49"/49"/40" | 1-0,3-3/3-3,1-0/1-0,1-2 | Test |
| J | 50/1 cc spun | — | 40 d. "Lycra" T126 | 28 | 9" | 72"/40" | 2-3,1-0/1-0,1-2 | Control |

*P875 AB = Nylon/"Dacron" cospun filament yarn; "A" means antistat; and "B" means Bright yarn.

Greige Fabric Properties

| Fabric No. | Wt. oz/yd$^2$ | Count* W × C/inch | Hand Stretch* % W % C | Thickness BSI | Bulk CC/g | Width |
|---|---|---|---|---|---|---|
| A | 2.4 | 36 × 54 | 25 × 48 | .015" | 4.68 | 71" |
| B | 1.9 | 44 × 64 | 40 × 60 | .014" | 5.52 | 60" |
| C | 2.1 | 48 × 72 | 45 × 55 | .014" | 4.99 | 58" |
| D | 2.7 | 52 × 96 | 55 × 45 | .016" | 4.44 | 54" |
| E | 4.4 | — | — | — | — | — |
| F | 3.7 | — | — | — | — | — |
| G | 7.0 | 50 × 80 | 70 × 95 | .047" | 5.13 | 47" |
| H | 9.8 | 51 × 80 | 80 × 65 | .057" | 4.40 | 65" |
| I | 9.6 | 45 × 83 | 50 × 75 | .056" | 4.40 | 52" |
| J | 8.3 | 47 × 80 | 80 × 90 | .049" | 4.41 | 49¼" |

Boiled Off Fabric Properties

| Fabric No. | Wt. oz/yd$^2$ | Count W × C/inch | Thickness BSI | Bulk cc/g | Width | Hand Stretch % W % C | Power lbs/in$^2$ |
|---|---|---|---|---|---|---|---|
| A | 3.1 | 44 × 64 | .018" | 4.35 | 59" | 30 × 60 | — |
| B | 22.2 | 50.72 | .017" | 5.79 | 51" | 55 × 85 | — |
| C | 2.5 | 56 × 76 | .016" | 4.79 | 50" | 65 × 80 | — |
| D | 3.0 | 62 × 90 | .017" | 4.24 | 45" | 60 × 60 | — |
| E | 4.2 | 40 × 52 | .016" | 4.64 | 61" | 25 × 40 | — |
| F | 3.2 | 56 × 44 | .025" | 5.85 | 45" | 20 × 25 | — |
| G | 11.0 | 60 × 96 | .054" | 3.68 | 37" | 96 × 105 | .34 × .27 |
| H | 14.4 | 54 × 98 | .066" | 3.44 | 42¾" | 105 × 90 | .41 × .35 |
| I | 15.1 | 52 × 96 | .073" | 3.63 | 42¼" | 110 × 100 | .35 × .27 |
| J | 11.6 | 50 × 96 | .051" | 3.29 | 41¾" | 136 × 103 | .17 × .24 |

*W = wale or length direction

C = course or width direction

While the invention has been illustrated using elastomeric yarns it should be understood that a stretchable textured yarn would provide similar surface effects. This technology is also useful for two needle bed warp knit machines; e.g., "simplex" machines.

I claim:

1. A method of warp knitting a plurality of threads from at least two guide bars on a warp knitting machine operating in a repeating stitch pattern which comprises the steps of: operating first guide threads in a repeating stitch pattern of alternating laid-in and knit-in stitches, while operating second guide threads in a repeating stitch pattern that is opposite to said first guide threads stitch pattern wherein when said first guide threads are laid-in, said second guide threads are knit-in, and subsequently repeating both stitch patterns.

2. The method of claim 1, including the additional step of operating third guide threads in conjunction with said first and second guide threads in a knit-in stitch pattern.

3. The method of claim 1, including the additional step of operating third guide threads in conjunction with first and second guide threads in a stitch pattern having a combination of a laid-in and a knit-in stitch.

4. The method of claim 1, including the additional step of operating third guide threads in conjunction with said first and second guide threads in a stitch pattern in a laid-in stitch pattern.

5. The method of claims 2, 3 or 4 wherein said third guide threads are elastomeric threads.

* * * * *